United States Patent [19]

Scheld

[11] Patent Number: 4,834,894

[45] Date of Patent: May 30, 1989

[54] PTFE OIL ADDITIVE

[75] Inventor: John L. Scheld, West Orange, N.J.

[73] Assignee: Tribophysics Corporation, Wayne, N.J.

[21] Appl. No.: 162,491

[22] Filed: Sep. 29, 1987

Related U.S. Application Data

[63] Continuation of Ser. No. 910,616, Sep. 23, 1986, abandoned, which is a continuation of Ser. No. 220,654, Dec. 26, 1980, abandoned.

[51] Int. Cl.[4] ..... C10M 105/74; C10M 131/04

[52] U.S. Cl. ..... 252/49.9; 252/18; 252/25; 252/58

[58] Field of Search ..... 252/18, 25, 49.9, 58

[56] References Cited

U.S. PATENT DOCUMENTS

| | | | |
|---|---|---|---|
| 2,245,649 | 6/1941 | Caprio | 252/54 |
| 2,510,112 | 6/1950 | Holbrook | 260/29.6 |
| 3,159,577 | 12/1964 | Ambrose et al. | 252/28 |
| 3,194,762 | 7/1965 | Browning et al. | 252/51.5 |
| 3,202,626 | 8/1965 | FitzSimmons et al. | 252/58 UX |
| 3,247,116 | 4/1966 | Reiling | 252/58 |
| 3,345,424 | 10/1967 | Hauptschein et al. | 252/58 X |
| 3,432,431 | 3/1969 | Mitacek | 252/16 |
| 3,432,511 | 3/1969 | Reiling | 252/58 X |
| 3,445,393 | 5/1969 | Hinds | 252/58 |
| 3,493,513 | 2/1970 | Petriello | 252/58 |
| 3,505,229 | 4/1970 | Skeham | 252/54 |
| 3,600,309 | 8/1971 | Laser et al. | 252/58 X |
| 3,630,901 | 12/1971 | Messina et al. | 252/51 |
| 3,634,246 | 1/1972 | Quaal | 252/49.9 |
| 3,640,859 | 2/1972 | Messina | 252/54 |
| 3,723,317 | 3/1973 | Ellsworth | 252/515 R |
| 3,857,789 | 12/1974 | Krupin et al. | 252/33.4 |
| 3,917,537 | 11/1975 | Elsdon | 252/11 |
| 3,933,656 | 1/1976 | Reick | 252/25 |
| 3,992,309 | 11/1976 | Dounchis | 252/49.8 |
| 4,029,870 | 6/1977 | Brown | 526/255 |
| 4,036,718 | 7/1977 | Brown et al. | 252/58 X |
| 4,096,079 | 6/1978 | Pardee | 252/51.5 R |
| 4,127,491 | 11/1978 | Reick | 252/16 |
| 4,203,854 | 5/1980 | Silverstein | 252/18 X |
| 4,224,173 | 9/1980 | Reick | 252/58 X |
| 4,243,434 | 1/1981 | Hartley et al. | 252/49.9 X |

FOREIGN PATENT DOCUMENTS

| | | |
|---|---|---|
| 1322375 | 8/1973 | United Kingdom . |
| 1370677 | 10/1974 | United Kingdom . |
| 2026536 | 2/1980 | United Kingdom . |

*Primary Examiner*—William R. Dixon, Jr.
*Assistant Examiner*—Margaret B. Medley
*Attorney, Agent, or Firm*—James Creighton Wray

[57] ABSTRACT

A liquid lubricant or spray-on coating consisting essentially of polytetrafluoroethylene particles which are sintered and ground and then physically dispersed in a tricresyl phosphate carrier medium. The particles are pre-wet with aliphatic naphtha and are coated with 10 W. to 70 W. oil having a lower miscibility in tricresyl phosphate and a lower specific gravity than tricresyl phosphate. The diameter of particles is in the range of about 0.5 microns to about 20 microns. The stability of the dispersion is achieved by lowering the specific gravity of the polytetrafluoroethylene particles by coating the particles with 10 W. to 70 W. oil.

13 Claims, No Drawings

PTFE OIL ADDITIVE

This application is a continuation of application Ser. No. 910,616, filed Sept. 23, 1986, now abandoned, which is a continuation of application Ser. No. 220,654, filed Dec. 26, 1980, now abandoned.

BACKGROUND OF THE INVENTION

This invention relates generally to lubricants and more particularly has reference to lubricants containing a dispersion of solid lubricant particles.

Pertinent U.S. and foreign patents are found in Class 252, subclasses 60 and 58 and in Class 585, subclass 12 of the Official Classification of Patents in the U.S. Patent and Trademark Office. Examples of pertinent patents are U.S. Pat. Nos. 2,510,112, 3,159,557, 3,194,762, 3,314,889, 3,432,431, 3,493,513, 3,505,229, 3,536,624, 3,640,859, 3,723,317, 3,933,656, 4,029,870, 4,127,491, 4,224,173.

U.S. Pat. No. 4,224,173 describes an eight step method for making lubricant oil containing polytetrafluoroethylene particles and a fluorochemical surfactant.

U.S. Pat. No. 2,510,112 describes an aqueous dispersion of colloidal polymerized polytetrafluoroethylene in a fluorinated hydrocarbon oil.

U.S. Pat. No. 3,194,762 describes a product having resin particles suspended in an oil base.

U.S. Pat. Nos. 3,159,557, 3,432,431, 3,493,513, 3,505,229, 3,630,901, and 3,640,859 describe greases containing polytetrafluoroethylene particles.

U.S. Pat. No. 3,723,317 describes a grease wherein triazene is combined with polytetrafluoroethylene to thicken a fluorinated polyether base oil.

U.S. Pat. No. 4,029,870 describes unsintered polytetrafluoroethylene which has been irradiated.

U.S. Pat. No. 3,933,656 describes sub-micron polytetrafluoroethylene particles.

U.S. Pat. No. 4,127,491 describes an aqueous dispersion of polytetrafluoroethylene particles.

The benefits of solid particle lubricant additives have been recognized for some time. Tests indicate varying but consistent improvements in engine efficiency through the use of molybdenum disulfide and graphite. The effects of solid particles as a cushion between sliding metal parts having been established, the natural tendency is to develop improved or advanced products. Polytetrafluoroethylene has been introduced as a solid particle additive that exhibits the same cushioning effects as molybdenum disulfate and graphite, but with the advantage of being a cleaner material to work with and a better or lower friction lubricant.

However, there are several problems associated with the use of polytetrafluoroethylene particle additives.

The preparation of a stable dispersion through chemical stabilization of polytetrafluoroethylene is a complex and exacting science. One such stabilization technique is described in U.S. Pat. No. 4,127,491.

Moreover, the dispersion achieved by the chemical stabilization method is short-lived. Upon standing for short periods of time, the particles settle and develop what could be called a "hard settle", i.e., the particles cannot be redispersed.

Added to the "hard settling" problem are the in-service problems of short-lived effectiveness. The apparent problem with dispersions achieved by the chemical stabilization method is that the surface active materials and film forming polymers become ineffective after a brief period of use.

SUMMARY OF THE INVENTION

The present invention overcomes many of the problems which exist in the prior art.

In the present invention, sintered and ground solid lubricant, preferably PFA (perfluorinated alkoxy), FEP (fluorinated ethylene propylene) or PTFE (polytetrafluoroethylene) particles are physically dispersed in a tricresyl phosphate carrier medium. The particles are pre-wet with aliphatic naphtha and are coated with 10 to 70 weight oil having a low miscibility in tricresyl phosphate and a lower specific gravity than tricresyl phosphate. The diameter of the particles is in the range of about 0.5 microns to about 20 microns.

The lubricant of the present invention is formed by mixing the pre-wet polytetrafluoroethylene particles with the 50 weight oil at high speed under vacuum. Mixing continues about 30 min. The tricresyl phosphate is then added and the resultant mixture is sheared at high speed under vacuum about 15 minutes.

The present invention is useful as an oil additive or as a spray-on coating.

One object of the invention is, therefore, to provide an improved lubricant.

Another object of the invention is to provide a lubricant containing a dispersion of solid lubricant particles.

Yet another object of the invention is to provide an oil additive containing a dispersion of polytetrafluoroethylene particles.

Still another object of the invention is to provide an improved spray-on coating.

Another object of the invention is to provide a lubricant comprising solid lubricant particles in a carrier medium, said particles being coated with a buoyant medium having lower specific gravity than the carrier medium.

Yet another object of the invention is to provide a composition of matter comprising polytetrafluoroethylene particles in a tricresyl phosphate carrier medium.

Still another object of the invention is to provide a method for reducing the apparent specific gravity of particles comprising coating the particles with a material having a relatively low specific gravity.

A further object of the invention is to provide a lubricating oil additive comprising solid lubricant particles in combination with tricresyl phosphate carrier medium.

Another object of the invention is to provide a method of dispersing solid particles in lubricating oil comprising dispersing said particles in a tricresyl phosphate carrier medium to form an oil additive, and combining said additive with said oil.

Another object of the invention is to provide a method of wetting polytetrafluoroethylene material comprising coating said material with aliphatic naphtha.

Another object of the invention is to provide wetted polytetrafluoroethylene material comprising polytetrafluoroethylene material coated with aliphatic naphtha.

Still another object of the invention is to provide a method of making a stable dispersion comprising combining particles with a buoyant medium to form a first combination, subjecting the first combination to an atmosphere drawn to substantially vacuum, mixing the first combination at high speed in said atmosphere, combining the mixed first combination with the carrier medium to form a second combination, subjecting the second combination to an atmosphere drawn to substantially vacuum, and shearing the second combination at high speed in said atmosphere.

These and other and further objects and features of the invention are apparent in the disclosure which includes the above and below specification and claims.

DETAILED DESCRIPTION OF THE INVENTION

This invention is directed to the formation of a lubricant which is primarily useful as an oil additive in engines but which can also be used as a spray-on coating to reduce ice formation and drag on surfaces.

The lubricant of the present invention has ground and sintered polytetrafluoroethylene particles physically dispersed in a carrier medium. Such a dispersion was heretofore thought to be impossible because of the high specific gravity of polytetrafluoroethylene.

The theory of creating the suspension in the present invention is relatively straightforward. Heavy particles, such as polytetrafluoroethylene particles, are coated with a relatively low specific gravity buoyant medium, thus lowering the apparent specific gravity of the particles. The coated particles are then floated in a relatively high specific gravity carrier medium. The resulting dispersion will stand for months and will not become solid or difficult to redisperse.

Ground polytetrafluoroethylene particles are used because of their durability and because of their inertness and electrostatic neutrality. The latter characteristics keep the particles from agglomerating.

The use of sintered polytetrafluoroethylene particles reduces the possibility of low boiling polytetrafluoroethylene particles being introduced to the combustion process of an engine. Sintered particles also have smoother surfaces and a more uniform geometry than the non-sintered particles used in the prior art.

The polytetrafluoroethylene particles used in the present invention are generally larger than the particles used in the prior art. The maximum particle size is determined by the intended use of the lubricant. For engine use, the particles must be small enough to pass through the engine's oil filter.

Preferably, the particles have a diameter of below 7 microns for about 90% of the particles. Particles at the upper ends of the useful ranges are more difficult to keep dispersed.

Polytetrafluoroethylene particles manufactured by LNP Corporation of Philadelphia, Pa., under the designation TL 102 are particularly suited to the present invention.

Preferably, the particles make up about 2 percent to about 25 percent of the volume of the lubricant.

Efforts to calculate the buoyant effect of the low specific gravity medium on the basis of surface area vs. particle mass prove to be no more accurate than the empirically derived method of adding more low specific gravity medium than is necessary and allowing it to rise to the top of the dispersion when it is mixed with the high specific gravity medium. It is important to use a low specific gravity medium that has low miscibility in the high specific gravity medium, and to start by adding to the miscibility point.

Tricresyl phosphate is particularly useful as the high specific gravity medium of the present invention. Tricresyl phosphate has been used for many years as a high pressure lubricant additive in greases, oils and gasoline. In addition to its lubricant properties, tricresyl phosphate tends to attach to scarred places in a cylinder wall, for example, and prevents further abrasion in that area. This is an extremely beneficial phenomenon and tests by NASA have shown oil life extended to 20,000 miles through the use of tricresyl phosphate additives.

Example: Shell Oil Company's aviation grade 10 to 70 w. oil is the preferred low specific gravity medium used in the present invention. That oil was selected primarily because of its low specific gravity and high quality.

Agglomeration can be further prevented in the present invention by pre-wetting the polytetrafluoroethylene particles. Preferably, particles are pre-wet with aliphatic naphtha. Aliphatic naphtha is particularly useful because it wets out instantly, prohibits any agglomeration, breaks up any agglomeration that may already be present, and does not break down in oil.

Alternatively, the polytetrafluoroethylene particles can be pre-wet with any other compatible solvent such as kerosene.

A method for making the lubricant of the present invention can now be described.

The polytetrafluoroethylene particles are ground and sintered. The resulting powder is then pre-wet.

The low specific gravity oil is then added to the wetted powder. That mixture is then placed in a vacuum drawn at least 29.8 inches at standard barometric pressure of 29.92 inches. While the vacuum is being drawn, the mixture is blended at high speed. Preferably, the high speed mixing is at least 4,000 rpm. The mixing can be conveniently carried out in a standard dispersion mixer.

50 gallon quantities of the mixture will usually require 30 minutes of mixing and vacuum.

Tricresyl phosphate is then added and the resultant mixture is sheared and vacuumed for 15 minutes.

The end product is a stable dispersion. The excess low specific gravity oil will migrate to the top of the dispersion because it is lighter than the oil coated particles and the tricresyl phosphate.

A sample formula would be as follows:

polytetrafluoroethylene: 3 grams
aliphatic naphtha: 3 grams
Shell aviation grade 50 weight oil: 1.8 fluid ounces
tricresyl phosphate: 2.0 fluid ounces A lubricant made according to that formula is particularly useful as an oil additive in automobile engines.

When the lubricant of the present invention is used as an oil additive, it is preferred to use a quantity of additive which is about 2 percent to about 20 percent by volume of the oil capacity of the engine. However, other ratios can also be used. Acceptable results have been achieved with quantities of additive which were in excess of 10 percent by volume of the oil capacity of the engine.

When the lubricant of the present invention is used as a spray-on coating, it is preferred that the lubricant and a propellant be combined in a pressurized valved container in a ratio of about 1:19 by volume. However, that ratio can be changed without departing from the present invention.

It is not necessary that the lubricant be applied to surfaces by spraying. The lubricant can be applied to a surface in any manner such as rubbing, painting or dripping or in any other conventional manner.

While the invention has been described with reference to a specific embodiment, the exact nature and scope of the invention is defined in the following claims.

I claim:

1. A liquid lubricant having dispersed solid particles which is non-aqueous and does not use surfactants for stabilization of the solid particles consisting essentially of, solid lubricant particles, wherein the particles are polytetrafluoroethylene particles, a buoyant medium coating the solid lubricant particles, and a carrier medium having the coated solid lubricant particles dispersed therein, wherein the buoyant medium comprises a low specific gravity oil relative to the specific gravity of the carrier medium and wherein the oil comprises 10 W. to 70 W. oil, wherein the carrier medium comprises tricresyl phosphate, wherein the oil has a lower specific gravity than the tricresyl phosphate, and wherein the oil has a low miscibility in the tricresyl phosphate whereby stability of the dispersion is achieved by lowering the specific gravity of the solid lubricant particles by coating the particles with 10 W. to 70 W. oil, wherein the particles range in size from 0.5 to 20 microns, and wherein the amount of particles ranges from 2 to 15 percent of the composition.

2. The lubricant of claim 1 wherein the solid lubricant particles comprise sintered polytetrafluoroethylene particles.

3. The lubricant of claim 1 wherein the solid lubricant particles comprise ground polytetrafluoroethylene particles.

4. The lubricant of claim 1 wherein the polytetrafluoroethylene particles are ground to a size of about 5 microns.

5. The lubricant of claim 1 wherein the polytetrafluoroethylene particles are ground and sintered.

6. The lubricant of claim 1 wherein the concentration of buoyant medium in the carrier medium is at least at the miscibility point.

7. The lubricant of claim 1 wherein the buoyant medium comprises 10 w. to 50 w. oil.

8. The lubricant of claim 2 wherein the solid lubricant particles are pre-wet with a wetting agent, wherein the wetting agent consists of aliphatic naphtha in an amount of approximately 3% of the composition.

9. The lubricant of claim 1 wherein the solid lubricant particles are pre-wet with a wetting agent, wherein the wetting agent consists of kerosene in an amount of approximately 3% of the composition.

10. The lubricant of claim 1 wherein the concentration of said lubricating oil in the lubricant is in the range of about 95 percent to about 97 percent by volume.

11. The lubricant of claim 1 wherein said combination of particles, carrier medium and buoyant medium is further combined with a propellant under pressure in a valved container, wherein the concentration of propellant in said container is about 95% by volume.

12. A composition of matter consisting of polytetrafluoroethylene particles dispersed in a tricresyl phosphate carrier medium and prewet with naphtha further consisting of:

a 50 W. oil having a lower specific gravity than tricresyl phosphate, and having a low miscibility in tricresyl phosphate, the oil coating the particles, and thereby stabilizing the dispersion, wherein the naphtha comprises approximately 3 percent of the composition, wherein the particles comprise approximately 3 percent of the composition, wherein the oil comprises approximately 45 percent of the composition, and wherein the tricresyl phosphate comprises approximately 49 percent of the composition.

13. A spray-on coating comprising:

a liquid lubricant having dispersed solid particles which is non-aqueous and does not use surfactants for stabilization of the solid particles, the liquid lubricant consisting essentially of solid lubricant particles, wherein the particles are polytetrafluoroethylene particles, which range in size from 0.5 to 20 microns and comprise from 2 to 15% of the composition, a buoyant medium coating the solid lubricant particles, and a carrier medium having the coated solid lubricant particles dispersed therein, wherein the buoyant medium comprises a low specific gravity oil relative to the specific gravity of the carrier medium and wherein the oil comprises 10 W. to 70 W. oil, wherein the carrier medium comprises tricresyl phosphate, wherein the oil has a lower specific gravity than the tricresyl phosphate, and wherein the oil has a low miscibility in the tricresyl phosphate whereby stability of the dispersion is achieved by lowering the specific gravity of the solid lubricant particles by coating the particles with 10 W. to 70 W. oil;

a propellant, wherein the propellant, carrier medium, buoyant medium and particles are combined in a pressurized valve container, wherein the concentration of propellant in the container is about 95% by volume.

* * * * *